United States Patent [19]

Thomas

[11] 4,359,791

[45] Nov. 23, 1982

[54] FOLDING TRANSFER BENCH WITH IMPROVED ROLLER AND ARM ASSEMBLY

[75] Inventor: Morton I. Thomas, Nyack, N.Y.

[73] Assignee: Temco Products, Inc., Passaic, N.J.

[21] Appl. No.: 216,171

[22] Filed: Dec. 15, 1980

Related U.S. Application Data

[63] Continuation-in-part of Ser. No. 72,009, Sep. 4, 1979, Pat. No. 4,253,203.

[51] Int. Cl.[3] ..... A61H 33/02

[52] U.S. Cl. ..... 4/546; 4/559; 4/560; 248/430

[58] Field of Search ..... 4/578, 579, 556, 560, 4/546, 567, 611, 615, 573; 248/430; 5/81 B

[56] References Cited

U.S. PATENT DOCUMENTS

| | | | |
|---|---|---|---|
| 1,962,789 | 6/1934 | Simpson et al. | 248/430 |
| 2,648,849 | 8/1953 | Webb et al. | 4/560 |
| 2,903,047 | 9/1959 | Funyak | 248/430 |
| 3,090,969 | 5/1963 | Maling | 4/611 |
| 3,169,253 | 2/1965 | Segar | 4/611 |
| 3,703,733 | 11/1972 | McLoughlin | 4/556 |
| 3,758,894 | 9/1973 | Finley | 4/560 |
| 4,091,479 | 5/1978 | Hancock | 4/560 |
| 4,150,445 | 4/1979 | Bailey | 4/546 |

*Primary Examiner*—Henry K. Artis

*Attorney, Agent, or Firm*—Richard C. Woodbridge

[57] ABSTRACT

The chair of a transfer bench includes a single removable arm and four rollers attached to the underside of the chair by four multipurpose brackets. The single arm can be easily mounted on the right or left side of the chair so that the open side of the chair always faces toward the patient regardless of the orientation of the chair on the bench. Each of the roller brackets is fastened directly to the bottom of the chair for additional simplicity and strength. Two spring-loaded safety hooks on the underside of the chair allow the chair to be removed from the bench, rotated 180°, and safely remounted on the bench but facing in the opposite direction. A downwardly extending locking stud attached to the underside of one of the tubular tracks of the bench can be engaged by one of the spring-loaded safety hooks to keep the chair from moving when a patient attempts to sit in the chair.

10 Claims, 9 Drawing Figures

FOLDING TRANSFER BENCH WITH IMPROVED ROLLER AND ARM ASSEMBLY

CROSS-REFERENCE TO RELATED APPLICATIONS

This application is a continuation-in-part application based upon my copending U.S. application Ser. No. 06/072,009 entitled FOLDING TRANSFER BENCH filed by the present inventor, Morton I. Thomas, on Sept. 4, 1979, now U.S. Pat. No. 4,253,203. All parts of that earlier filed application are hereby incorporated by reference into this application.

BACKGROUND OF THE INVENTION

1. Field of the Invention

This invention concerns a roller mounted chair that is used by a patient to transfer into or out of a shower or bathtub area and wherein improvements have been made to the roller mounted chair to make it more safe and reliable.

2. Description of the Prior Art

Many typical prior art transfer benches include a simple, flat, water impervious seat, two pairs of legs which straddle the edge of the bathtub, and a back. In general it is difficult for some patients to slide across that type of prior art seat due to the friction of the surface of the seat and the weakness of the patient. In order to keep water from running off the seat and out of the tub, it is frequently necessary to make the inside legs slightly shorter than the outside legs. The resulting inclination can be hazardous to patients with limited muscular abilities. It is also not possible to draw a shower curtain across the bench when it is used because the seat interferes with the normal path of the curtain. It is also noted that it is difficult for a patient using a solid seat to clean himself from underneath. Moreover, the prior art design just described is generally uncomfortable because of the hard unyielding nature of the materials used.

Roller type transfer benches are known to a limited degree. For example, Maling, U.S. Pat. No. 3,090,969 entitled TRAVELLING CHAIR FOR SHOWER STALLS discloses an earlier version of a transfer bench in which a three-wheeled chair rides into and out of a shower stall on two parallel tracks of unequal length. Additional roller arrangements for getting into or out of bathtubs or shower stalls are disclosed in the following U.S. Pat. Nos. 3,703,733; 4,091,479; and 4,150,447.

U.S. Pat. Nos. 2,237,076 and 4,166,297 disclose non-movable bathtub chairs of possible limited interest.

SUMMARY OF THE INVENTION

Briefly described the present invention comprises an improved roller and arm assembly for use on the chair of a folding transfer bench. My parent copending application entitled FOLDING TRANSFER BENCH upon which this continuation in-part application is based, disclosed a collapsible bench which cooperates with a roller mounted chair so that a patient can slide into and out of a bathtub or shower area. The bench portion included a pair of tubular parallel tracks mounted on a pair of collapsible U-shaped leg sections. A bracket connected to each of the leg sections was employed to lock the legs in the open position. The bench could then be stored by dis-engaging the locking bracket and folding the legs up against the track.

The parent application further disclosed a chair mounted on four hour-glass shaped plastic rollers. A pair of rollers engaged each of the two tubular tracks of the folding transfer bench respectively. Two spring-loaded hooks attached to the underside of the chair loosely engage the tracks so as to prevent the chair from tipping. Accordingly, it was possible to turn the chair 180° by disengaging the hooks, rotating the chair apparatus and re-engaging the hooks so that the chair faced in the opposite direction. The chair included a padded seat having an access aperture therein, a back, and a pair of arms.

The prior application further disclosed a fabric genital guard connected across part of the underside of the seat aperture in order to protect males from genital damage as the chair passed over the edge of the bathtub. The genital guard was connected by releasable fasteners so that the flap could be disengaged and the patient could clean himself underneath.

The present invention comprises several improvements over the subject matter of the prior parent application. One of the important improvements comprises the use of relatively simple multipurpose bracket means directly connected to the underside of the chair to carry the hour-glass shaped rollers and the J-shaped safety hooks. The two front brackets also include apertures that allow a brace means to be attached selectively either to the right or left side of the chair thus allowing a single side arm member to be selectively attached either to the right side or left side of the chair as conditions require. A single arm member has been found to be more desirable than two arms because it is important to have the side of the chair facing the patient open so that the patient can sit in the chair without having to negotiate the arm section. The side arm is remountable so that it is possible to detach the chair from the bench, rotate it 180°, and remount it on the rails facing in the opposite direction. Under those circumstances the side arm would be remounted on the opposite side of the chair so that the patient doesn't have to climb over the side arm in order to sit down in the chair.

The improved transfer bench further includes a downwardly depending locking stud which is engageable by one of the J-shaped safety hooks. The locking studs are located at the end of the transfer bench that extends out of the bathtub or shower area. This feature allows the chair to be locked in position so that a patient can sit in it without fear of the chair sliding out underneath of him.

The folding transfer bench includes two U-shaped sections which both fold in the same direction. This is in contrast to the structure of the bench disclosed in the prior parent application in which the two leg sections could fold inwardly towards each other.

These and other features of the present invention will be more fully understood with reference to the following drawings and detailed description.

DETAILED DESCRIPTION OF THE PREFERRED EMBODIMENT

During the course of this description like numbers will be used to identify like elements in each of the figures which illustrate the invention. Where possible the same element numbers are used to identify similar elements that are found in my copending application, Ser. No. 06/072,009 entitled FOLDING TRANSFER BENCH and filed on Sept. 4, 1979. All parts of that copending application are hereby incorporated by reference into this disclosure.

Figure 1:
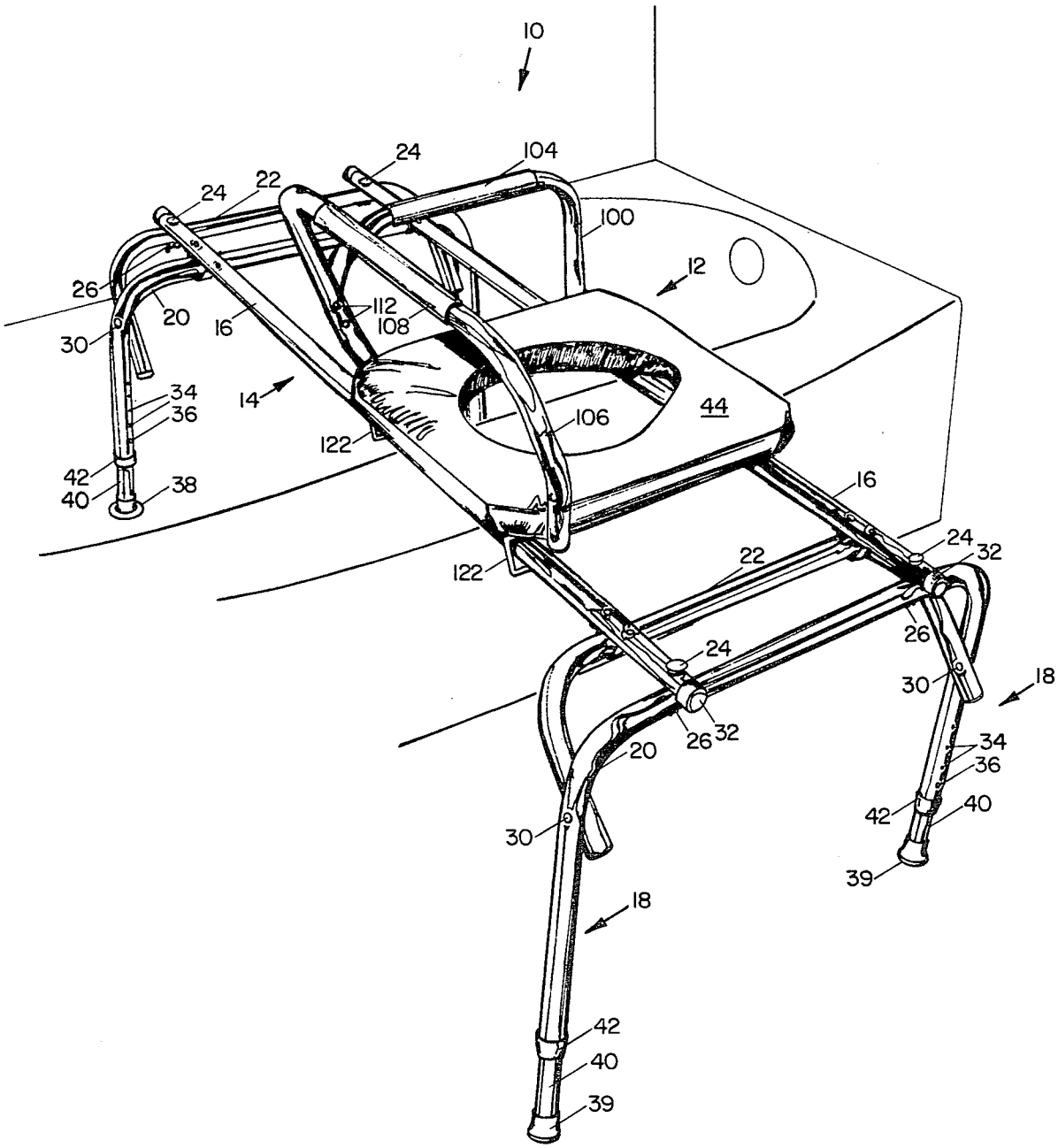
FIG. 1 is a rear perspective view of the preferred embodiment of the invention showing the chair mounted on the tubular tracks of the bench.
Figure 2A:
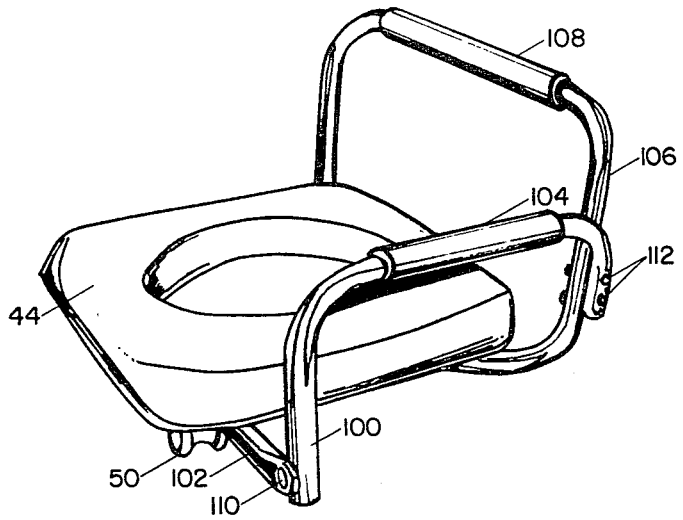
FIG. 2A is a right side perspective view of the chair.
Figure 2B:
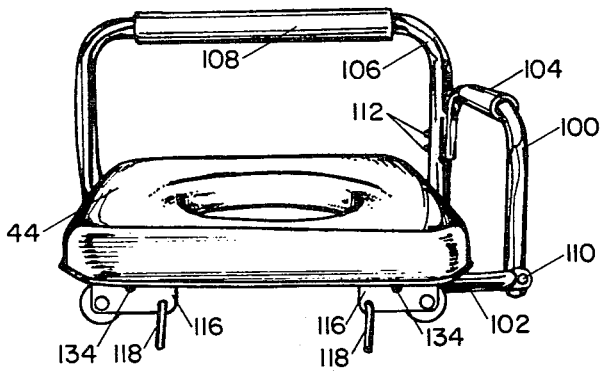
FIG. 2B is a front perspective view of the chair.
Figure 2C:
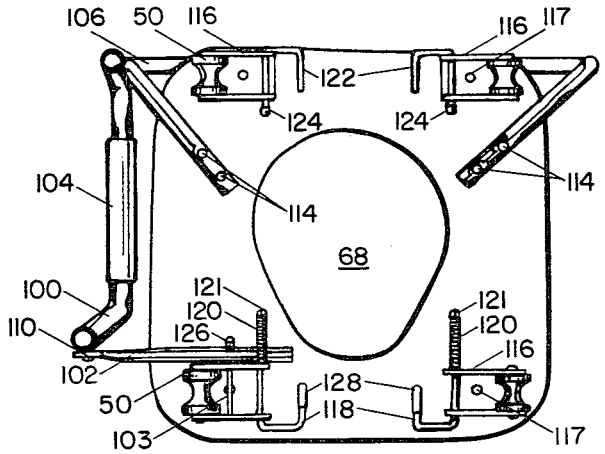
FIG. 2C is a bottom plan view of the chair showing the location of the bracket, rollers, safety hooks, side arm supports and back sections.

Details of the invention 10 may be understood by referring to FIGS. 1 through 3B. As shown in FIG. 1, the invention 10 essentially includes a roller mounted chair 12 and a folding bench 14. Bench 14 includes a pair of tubular bench rails 16 supported by four legs 18. Typically two of the legs 18 are located inside the bathtub and are terminated by non-skid rubber suction feet 38. The other two legs 18 are located outside of the tub and are terminated with conventional non-suction rubber tipped feet 39. Two U-shaped elements 20 located respectively at opposite ends of bench 14 comprise the upper section of each of the four legs 18. The free ends of a pair of U-shaped braces are attached by rivets 30 to the depending portions of the tubular U-shaped elements 20. U-shaped braces 22 straddle the span between the two legs 18 at each end of bench 14 and are rotatable about rivets 30. At the end of the bench that normally is located outside of the bath area the U-shaped brace 22 is attached to each of the rails 16 by trunion-like brackets 28. Similarly, on the outside of the tub, the tubular U-shaped elements 20 which comprise part of the leg sections 18 are attached to the tubular rails 16 by a pair of bolts 24 and wing nuts 26. Conversely at the end of the bench 14 which is normally located inside of the bath area, the tubular U-shaped element 20 is attached directly to the two rails 16 by trunion-like brackets 28 similar to the ones that attach U-shaped brace 22 to the rails 16 at the end of the bench 14 located outside of the tub. Moreover, the ends of the rails 16 are attached by bolts 24 and wing nuts 26 to the U-shaped elements 22 located inside of the bathtub. Therefore, the role and function of trunion-like brackets 28 reverses between use on the inside of the bath area and use on the outside of the bath area.

Both ends of tubular tracks 16 are covered by protective plastic caps 32. Each of the legs 18 include a lower portion 40 that telescopes into the upper U-shaped element 20. A damping collar 42 is typically located between lower section 40 and upper section 20 to minimize the undesirable effects of vibration. Upper section 20 includes a plurality of height adjustment holes 34 which are selectively engagable by a locking button 36. Locking button 36 is carried by and housed within lower tubular member 40. The length of each of the legs 18 is varied by simply depressing the button 36 and pushing or pulling on the lower member 40 until the button 36 re-emerges in another height adjustment hole 34.

Chair 12 essentially comprises a seat 44, a side arm 100, a back 106 and four Nylon® rollers 50 mounted underneath seat 44. Each of the Nylon® rollers 50 includes a concave portion 52 which gives the rollers 50 an hour-glass like shape. An axel rod 53 passes through the center of each of the rollers 50 and is supported by roller brackets 116 at each end of the axel rod 53.

Details of the seat 12 are best disclosed in FIGS. 2A–3B. The single side arm 100 is attached by side arm brace 102 to one of the front roller brackets 116. A long machine bolt 103 act as a pin to rigidly hold the side arm brace 102 against one of the rearwardly facing surfaces of one of the front roller brackets 116. A rivet 110 passes through the flattened end of the side arm brace 102 and a first end of the side arm 100 and forms a rotatable connection therewith. The connection formed by rivet 110 is rotatable so that the side arm 100 can be disconnected from the chair 12 and re-attached on the other side. A tubular cushion 104 is mounted on side arm 100 to provide comfortable flexible support to the patient using the apparatus. A second end of the side arm 100 is attached by a pair of machine bolts and nuts 112 to the tubular support frame of the back section 106. Nut and bolt combinations 112 can be easily unscrewed so that the side arm 100 may be remounted on the other side of the back 106.

A tubular cushion 108 is positioned along the upper side of back 106 to provide comfortable support for a patient in the same manner that cushion 104 of side arm 100 performs the same function. Chair back 106 comprises a single formed piece of metal tubing whose ends bend under seat 44 and are attached thereto by several machine screws 114.

Each of the roller brackets 116 is connected directly and securely to the underside of seat 44 by one or more wood screws 117. In addition to carrying the rollers 50 the roller brackets 16 carry a safety hook 118 or 122. Each of the front roller brackets 116 carry a front safety hook 118. Front safety hooks 118 are biased by springs 120 into a position that draws them towards the rear of the chair 12. Springs 120 work against the rear surface of each of the front roller brackets 16 and against the heads 121 of the front safety hooks 118. The other ends of the front safety hooks 118 are covered by a rubbertip 128 which serves to protect the user and the equipment from damage due to the biasing force of the springs 120.

The two rear safety hooks 122 are respectively carried by the two rear roller brackets 116. Rear safety hooks 122 are not spring biased. Each of the rear safety hooks 122 includes a head portion 124 which prevents the rear safety hooks 122 from separating from the rear roller brackets 116. In a similar manner, pin 103 is secured in position with respect to the side arm brace 102 and the front roller brackets 116 by the head 126 of machine bolt 103. Pin 103 is received in aperture 134 in either one of the front roller brackets 116. A plastic bushing 132 is also located in roller brackets 116 to allow the safety hooks 118 or 122 to rotate freely.

Figure 3A:
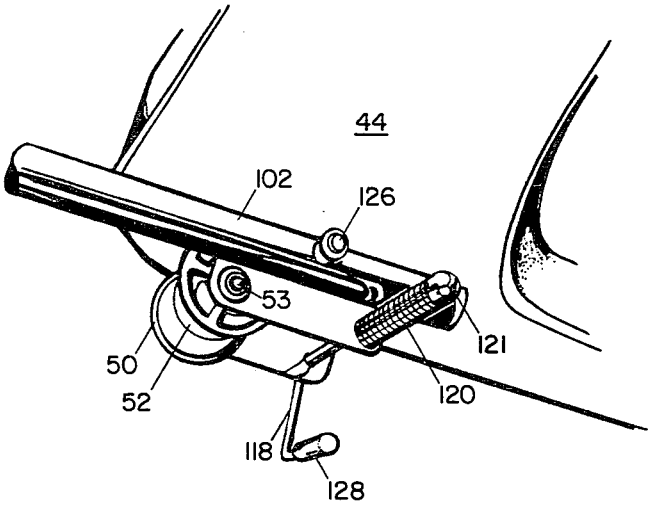
FIG. 3A is a bottom detail perspective view of the roller bracket assembly.
Figure 3B:
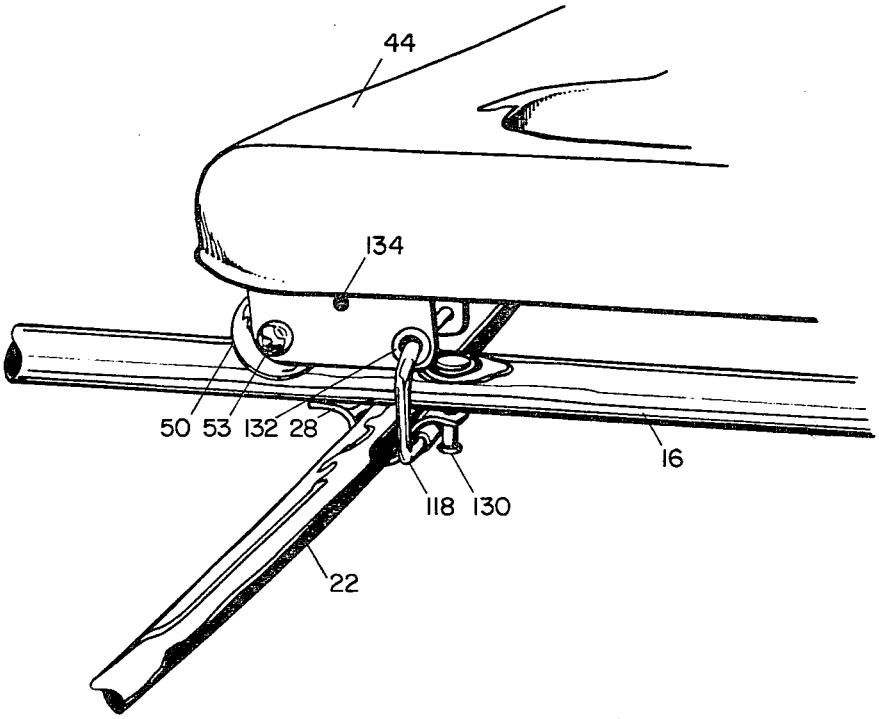
FIG. 3B is a front detail perspective view of the roller bracket assembly showing the safety hook engaged in the locking position with respect to the locking stud.

A pair of downwardly depending safety hook locking engagement studs 130 are attached to each of the rails 16 on the portion of the bench 14 that is located outside of the bath area. FIG. 3B specifically illustrates how the locking engagement stud 130 comprises an extended rivet which passes through each of the tubular rails 16 and comprises part of the attachment for the two trunion-like brackets 28 which rotatably attach the tubular rails 16 to the rotatable U-shaped braces 22. The purpose of locking engagement studs 130 is to provide a place where the front safety hooks 118 can lock to the frame of the bench 12. In this manner the chair 12 can be temporarily immobilized with respect to bench 14 to keep it from rolling when a patient attempts to sit on the seat 44. Once the patient is firmly in the seat 44 the front safety hook 118 is disengaged from the pocket formed between trunion-like bearing 28 and downwardly depending stud 130 and the seat 44 and the patient are free to roll into the bath area. Spring 120 allows the safety hook 118 to be selectively engaged or dis-engaged from the pocket formed between stud 130 and trunion-like bracket 28. In the locked position spring 120 normally biases the front safety hook 118 to keep it in the locked position.

Figure 4A:
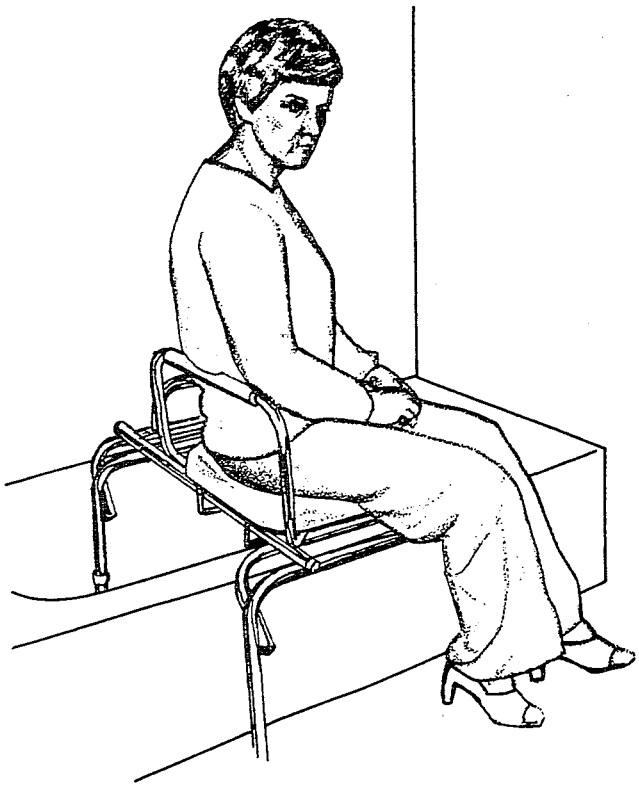
FIG. 4A illustrates the first step in the use of the invention as a patient begins to sit down on the chair and the chair is locked in position farthest from the inside of the tub.
Figure 4B:
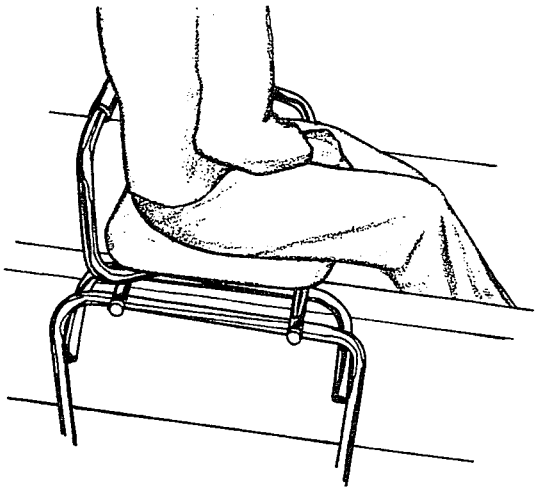
FIG. 4B illustrates the second step in the use of the invention in which the patient has placed his feet inside of the bath area and unlocked the chair from its locked position.
Figure 4C:
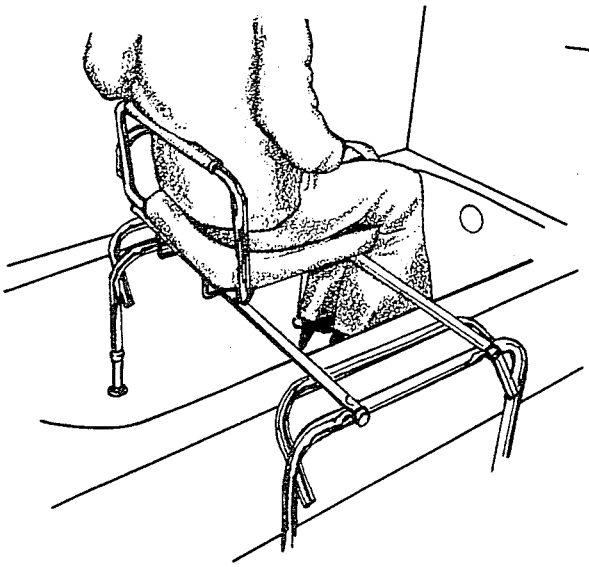
FIG. 4C illustrates the very final step where the chair has been rolled into the bath area.

FIGS. 4A through 4C illustrate the manner in which a patient uses the invention 10. Prior to the the step illustrated in FIG. 4A, the bench 14 is erected in the manner illustrated in FIG. 1 so that the rubber tipped suction feet 38 are located inside the tub and the chair 12 is correctly mounted on the tracks 16 with the safety hooks engaged to prevent tipping. Moreover, the chair is preferably locked in position on the outside of the tub by the technique illustrated in detail in FIG. 3B and the single side arm 100 is mounted on the side of the chair that faces towards the bath area.

The first step in using the invention 10 is for the patient to sit on the chair 12 in the manner illustrated in FIG. 4A. The second step, illustrated in FIG. 4B is for the patient to bring his legs into the bath area. The third step comprises dis-engaging the front safety hook 118 from the locking engagement stud 130 so that the chair 12 is free to roll on tracks 16. Fourthly, and lastly, the chair 12 is rolled into the bath area so that the patient may bathe. If desired, an additional pair of locking engagement studs 130 can be attached to rails 16 at the ends which normally are located within the bath area so that the chair 12 can be locked in position in the bath area. However, it is normally not desirable to lock the chair in the bath area since the locking and unlocking function is frequently performed by an attendant who would have to reach over the patient to lock or release the front safety hook 118. The patient can get out of the bath area simply by reversing the sequence of steps illustrated in FIGS. 4A through 4C making sure to lock the seat 12 with respect to bench 14 prior to dismounting.

In the mode illustrated in FIG. 1 and FIGS. 4A–4C, the chair faces towards the front of the tub so that the patient is looking at either a shower head or water faucet. Frequently it is desirable for the patient to face in the opposite direction. This invention 10 has the ability to easily and safely turn the chair in the opposite direction. The following steps are taken to accomplish that function. First, chair 12 is removed from tracks 16 by disengaging the spring loaded front hooks 118. Secondly, side arm 100 is disengaged from chair 12 by unfastening nut and bolt combination 112 and by undoing threaded machine bolt 103. Arm 100 is then remounted on the other side of the chair by refastening nut and bolt combination 112 on the other side of the back frame 106 and by swiveling mounting brace 102 180° around rivet 110 and then remounting brace 102 on the other front roller bracket 116 with pin 103 in a manner similar to that disclosed in detail in FIG. 2C. Thirdly, the chair is rotated 180° in a plane parallel to the plane of tracks 16 and then remounted facing in the direction opposite to its former orientation. The remounting is easily accomplished by first engaging rear safety hooks 122 and then pulling on front safety hooks 118 so that they clear rails 16 and then letting them relax so that both the front safety hooks 118 and the rear safety hooks 122 loosely engage the rails 16. Fourthly, and lastly, the other front safety hook 118 engages the other locking engagement stud 130 to keep the chair from rolling. After the foregoing steps have been taken it will be clear that the remounted arm 100 is again located on the portion of the chair 12 that is farthest from the outside of the bathtub so that a patient can easily mount seat 44 without having to climb over an arm. The patient then uses the invention 10 to get into and out of the bathtub in a manner directly similar to that described with respect to FIGS. 4A4C.

The foregoing invention provides the following distinct advantages:

A. It is possible to lock the chair 12 in position with respect to the bench 14 so that a patient can mount or dismount the chair 12 without fear of it rolling away from him. The locking feature is effective in both the forward facing and rear facing modes.

B. A remountable side arm 100 allows the patient easy access to the seat 44 while at the same time providing adequate support for the patient during use. By making the side arm 100 remountable it is possible to use the same chair and the same equipment regardless of whether or not the chair 12 faces forwardly or rearwardly.

C. The disclosed structure of the multipurpose roller brackets 116 provides for an especially safe and economical structure. By connecting the brackets 116 directly to the underside of seat 44 a great deal of vibration has been minimized. The brackets 116 also perform double and triple functions by carrying rollers 50 along with front or rear safety hooks 118 and 122 or pin 103 which carries side arm brace 102. By directly attaching these elements to parts of the chair that are securely integral with the chair structure a great deal of additional rigidity is accomplished. Similarly, the structure of the side arm 100 and the back section 106 is especially simple and direct. Note that the free ends of the back 106 are attached directly to the underside of the chair, thereby further minimizing vibrational and tortional stresses.

D. The structure of the bench 14 is improved in part by the difference between the leg structures inside and outside of the bathtub. On the outside of the bathtub the legs 18 are located directly under the rails 16 at the point farthest down rails 16. This provides the widest and longest possible base for the bench 14 outside of the bath area. Conversely the legs 18 on the inside of the bath area are not located at the farthest end of the rails 16 but instead are located inwardly of the U-shaped rotatable brace 22. The reason is that it is not possible to locate legs 18 at the farthest end of the inside rails 16 due to the natural curvature of the tub which forces the legs 18 to be located somewhat inwardly of the end of the rails 16 which typically overlap the curved edge of the tub somewhat. The foregoing leg structure means that the bench 14 has the widest possible base and therefore provides the maximum stability.

E. Lastly, it will be appreciated that the bench 14 can be easily disassembled and stored or packaged for shipment and then subsquently erected to form a very stable and reliable invalid aid. Similarly the chair is easily knocked down for storage and shipment purposes and readily erectable to its utilizable mode as illustrated in FIGS. 1 through 4C.

According to the preferred embodiment of the invention the tubular elements may be formed either from conventional steel or aluminum materials. Seat 44 of chair 12 is covered preferably by a cleanable plastic material and stuffed with foam or a suitable substrate to provide comfortable cushioning for the patient.

While the invention has been described with reference to a preferred embodiment thereof it will be appreciated by those of ordinary skill in the art that various changes can be made to the structure and function of the various parts that comprise the invention without departing from the spirit and scope thereof.

I claim:

1. In a transfer bench apparatus including a movable chair, rolled means attached to the underside of said chair, a bench including at least two substantially parallel tubular tracks for supporting said roller means, and releasable means attached to said chair for loosely engaging at least one of said tubular tracks, the improvement comprising:

bracket means attached to the underside of said chair for rotatably supporting said roller means, said bracket means further supporting and carrying said releasable means; and, an engagement means attached to said bench for selectively engaging one of said releasable means in order to keep said chair from moving during the period in which a patient attempts to sit in said chair.

2. The apparatus of claim 1 further comprising:

a releasable and remountable side arm attachable to said chair.

3. The apparatus of claim 2 further comprising:

a brace means attachable to the underside of said chair and also attached to a first end of said side arm.

4. The apparatus of claim 3 further comprising:

a back means comprising a substantially continuous member having two free ends thereof connected directly to the bottom side of said chair.

5. The apparatus of claim 4 further comprising:

a first releasable means for connecting said brace means to one of said brackets; and, a second releasable means for connecting a second end of said side arm to said back means.

6. The apparatus of claim 5 wherein at least two of said bracket means include attachment point means for selectively attaching to the end of said brace means not connected to said side arm; and, wherein said back means includes at least two attachment points on opposite sides thereof for attachment to said second end of said side arm, whereby said brace means and said side arm can be selectively attached to either side of said chair to allow a patient to approach said chair and sit in said chair from a direction opposite from the side on which said side arm is mounted.

7. The apparatus of claim 6 wherein said apparatus includes at least four of said bracket means, each of said bracket means respectively carrying a roller means and a hook means, at least two of said hook means including a spring bias means so that said spring biased hook means can be selectively withdrawn from disengagement with one of said tubular tracks thereby allowing said chair to be rotated 180° and remounted facing in the opposite direction.

8. The apparatus of claim 7 wherein said means for connecting said brace means to said one of said bracket means comprises a threaded pin means.

9. The apparatus of claim 8 wherein said bench is foldable to a substantially flat position for storage purposes and is subsequently re-errectable for use in the upright position.

10. The apparatus of claim 9 wherein said foldable bench further includes:

adjustable leg means for changing the height of said bench; and, wherein said engagement means comprises a downwardly extending stud attached to the underside of said bench.

* * * * *